US006493883B2

(12) United States Patent
Jones

(10) Patent No.: US 6,493,883 B2
(45) Date of Patent: Dec. 17, 2002

(54) PORTABLE URINAL DEVICE

(76) Inventor: Terrell X. Jones, 13404 Hathaway Dr., Silver Spring, MD (US) 20906

( * ) Notice: Subject to any disclaimer, the term of this patent is extended or adjusted under 35 U.S.C. 154(b) by 0 days.

(21) Appl. No.: 09/758,162

(22) Filed: Jan. 12, 2001

(65) Prior Publication Data

US 2002/0092089 A1 Jul. 18, 2002

(51) Int. Cl.[7] ..... A47K 11/12
(52) U.S. Cl. ..... 4/144.1; 4/144.3
(58) Field of Search ..... 4/144.1, 144.2, 4/144.3; 604/349–352

(56) References Cited

U.S. PATENT DOCUMENTS 1,650,154 A * 11/1927 Randle ..... 4/114.1
1,721,832 A * 7/1929 Porter ..... 4/114.1
3,703,731 A * 11/1972 Leiser ..... 4/144.3
4,345,341 A * 8/1982 Saito ..... 4/144.3 X
4,631,061 A * 12/1986 Martin ..... 4/144.1 X
5,235,705 A * 8/1993 Belisle ..... 4/144.3
5,701,612 A 12/1997 Daneschvar
6,151,721 A * 11/2000 Whitfield ..... 4/144.1

* cited by examiner

*Primary Examiner*—Charles E. Phillips
(74) *Attorney, Agent, or Firm*—Cahn & Samuels, LLP

(57) ABSTRACT

A portable urinal device is provided with an elongated body having a first section and a second section, the first section being releasable connected to the second section. The first section includes an open end coupled to the second section and a closed end having a top surface. A retractable flexible tube having a first end secured within the first section and a second end that is retractable away from the top surface is preferably disposed about a spindle located within the first section. The second end of the flexible tube is preferably disposed outside the first section. A device for creating suction at the first end of the retractable tube so as to draw fluid from the second end of the flexible tube to the first end of the flexible tube is coupled to the first end of the flexible tube. A motor is operatively engaged with the spindle to rotate the spindle and retract the flexible tube into the first section. First and second extension members adapted for coupling to second end of the flexible tube are preferably secured to the top surface of the first section.

9 Claims, 7 Drawing Sheets

PORTABLE URINAL DEVICE

CROSS REFERENCE TO RELATED APPLICATION:

This application claims priority from U.S. application Ser. No. 09/481,529 filed Jan. 12, 2000 which is herein incorporated by reference and which is subject to a petition to conversion from Utility patent status to Provisional Patent status filed Dec. 21, 2000 and still pending.

BACKGROUND SUMMARY OF INVENTION

Bladder control problems, sometimes called urinary incontinence, affect millions of Americans. There are three types of bladder control problems: overactive bladder; sphincter abnormalities (stress incontinence); and mixed incontinence (a combination of both overactive bladder and sphincter abnormalities). Urge incontinence can result in the need to use the restroom at times when there is no readily available facility. This immediate need to relieve oneself may lead create situations that, unsightly, dangerous and even unlawful. Those individuals who are not fortunate enough to make it to a convenient restroom must settle for other alternatives. These alternatives can range from urinating in an alley, on the side of the road and, in severe instances, involuntary wetting. These situations can be embarrassing, and can lead to fines or, in the case of public urination, even citation.

Several transportable urinal device have been patented that may address some of the above issues. For example, U.S. Pat. No. 3,703,731 is directed to a device that includes a housing enclosing a container for storing urine. A hose is coupled to the container and coiled within the housing. The house is provided with an applicator to collect urine from the user. In use, the hose is reeled out of the housing and the applicator is applied to the user. U.S. Pat. No. 4,631,061 is directed to still another urinal device. The '061 patent discloses a device comprising a hose coupled to a receptacle for storing urine. A collection vessel is attached an end of the hose to minimize urine leakage. A vacuum pump is provided for suctioning urine through the hose into the container.

A significant issue with the prior art urine collection devices is the design of the collection vessel. It is desirable to use separate collection vessels for male and female users. For convenience and flexibility, both the male and female collection vessels should be readily accessible to the user.

In addition, in many prior art systems, the hose is left to dangle after the user has finished urinating. This can cause leakage problems that may lead to unsanitary conditions.

SUMMARY OF THE INVENTION

A portable urinal device according to the invention includes an elongated body having a first section and a second section, the first section being releasable connected to the second section. The first section includes an open end coupled to the second section and a closed end having a top surface. A retractable flexible tube having a first end secured within the first section and a second end that is retractable away from the top surface is preferably disposed about a spindle located within the first section. The second end of the flexible tube is preferably disposed outside the first section. A device for creating suction at the first end of the retractable tube so as to draw fluid from the second end of the flexible tube to the first end of the flexible tube is coupled to the first end of the flexible tube. A motor is operatively engaged with the spindle to rotate the spindle and retract the flexible tube into the first section. First and second extension members adapted for coupling to second end of the flexible tube are preferably secured to the top surface of the first section.

The portable urinal device of the present invention will allow men and women a practical alternative to public restrooms even at the most inconvenient times. Whether one is stuck in traffic, on a long road trip, or even if one just doesn't feel like using a public restroom. By coupling the extension members to the top surface of the device, the extension members are likely to be readily available wherever the device is found. Thus, men and women alike can comfortably use the device without fear of excessive leakage.

DETAILED DESCRIPTION OF THE DRAWINGS

Figure 1:
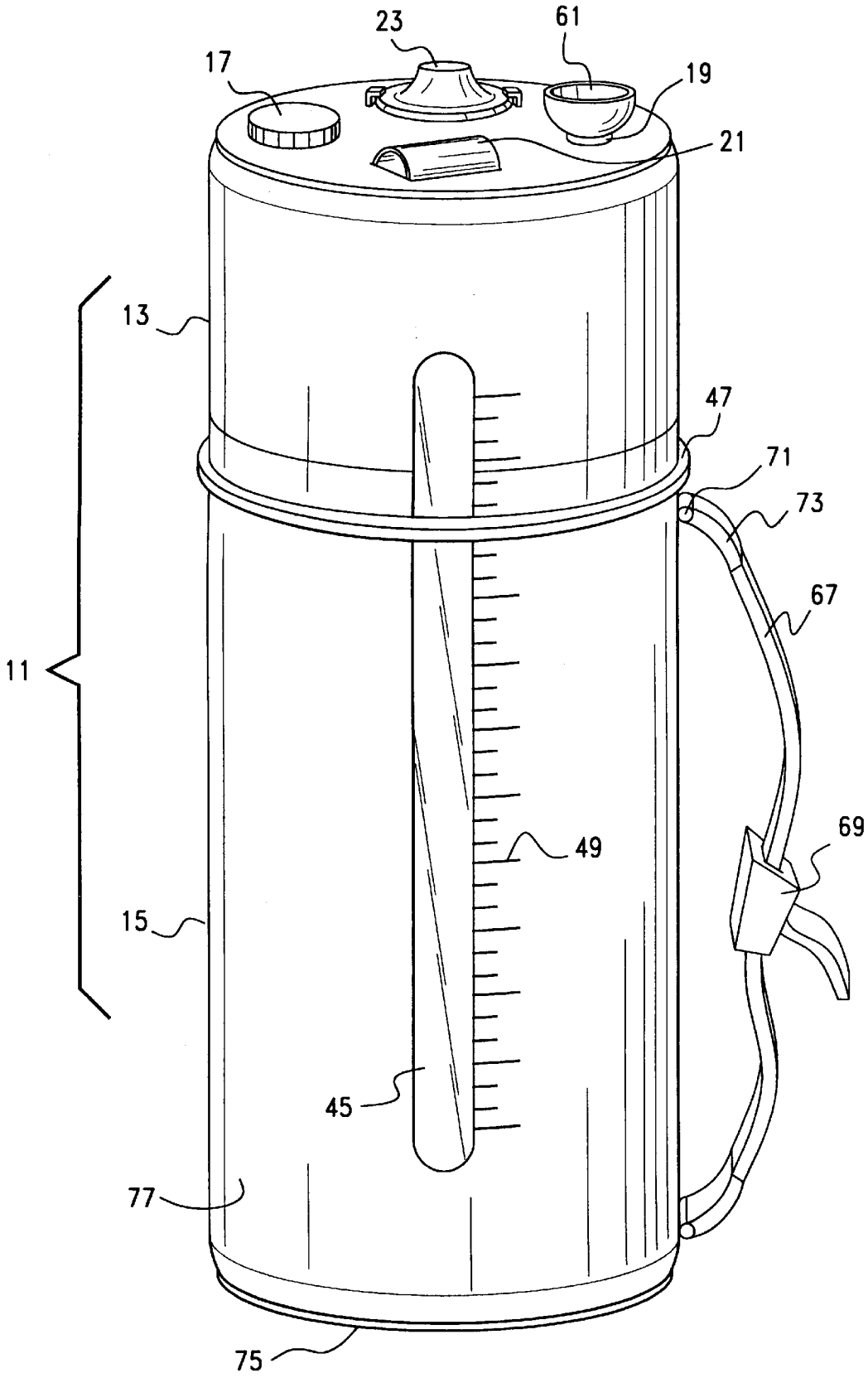
FIG. 1 is a perspective view of a portable urinal device according to the present invention.
Figure 2:
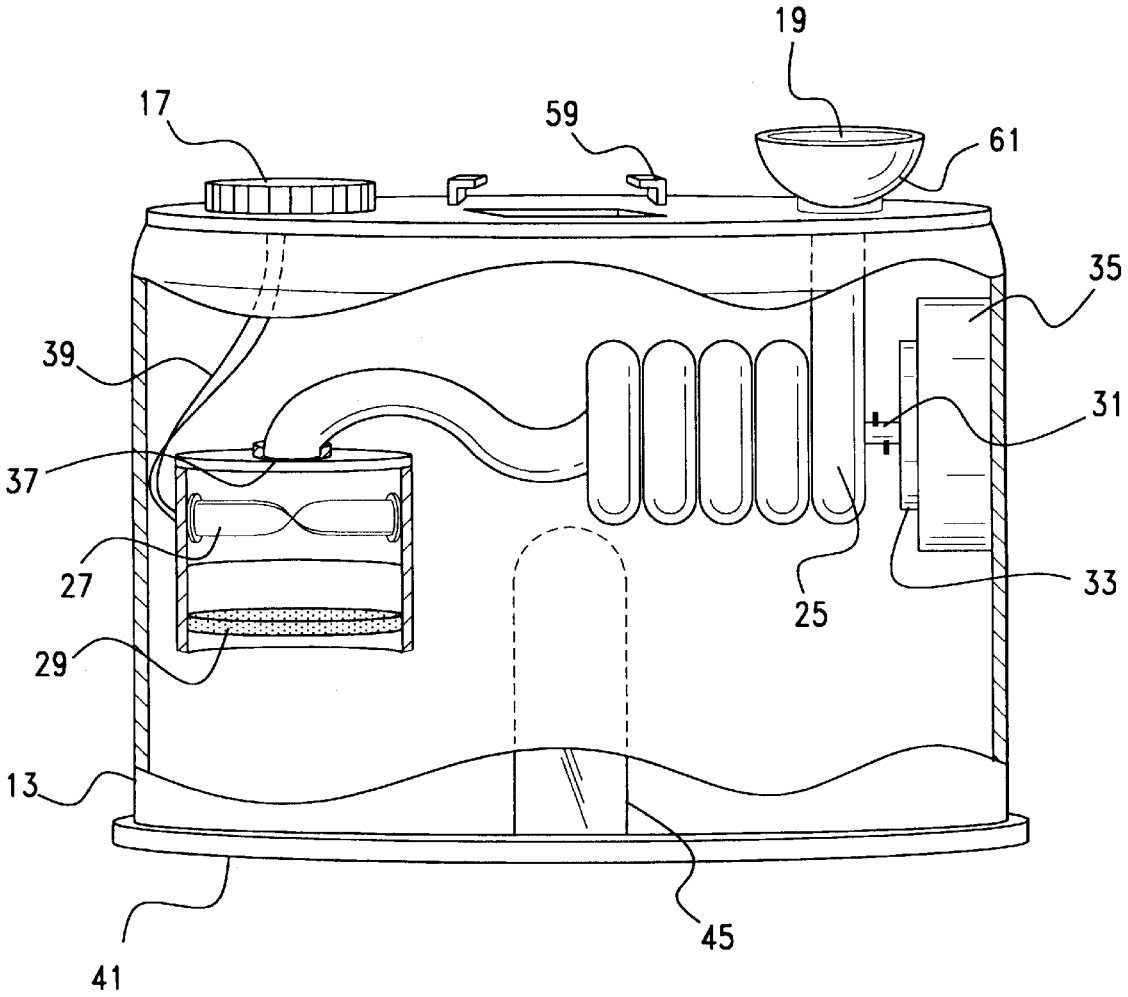
FIG. 2 is a cut away view of the first section of an embodiment of a urinal device according to the present invention.

Referring to FIG. 1, a portable urinal device in accordance with the invention is depicted. The portable urinal device includes a housing 11 preferably having a first section 13 and a second section 15. Housing 11 is preferably a generally cylindrical structure comprised of a rigid, durable plastic. As shown in FIG. 2, a flexible tube 25 may be disposed in the first section about spindle 31. In accordance with an embodiment of the invention, one end of flexible tube 25 may be connected to a suction device motor 27 that draws urine through a filter 29 to second section 15. The other end of flexible tube 25 may be provided with a funnel shaped tip 61 for receiving male and female extension members 21 and 23, respectively, designed to accommodate male and female users.

Figure 3:
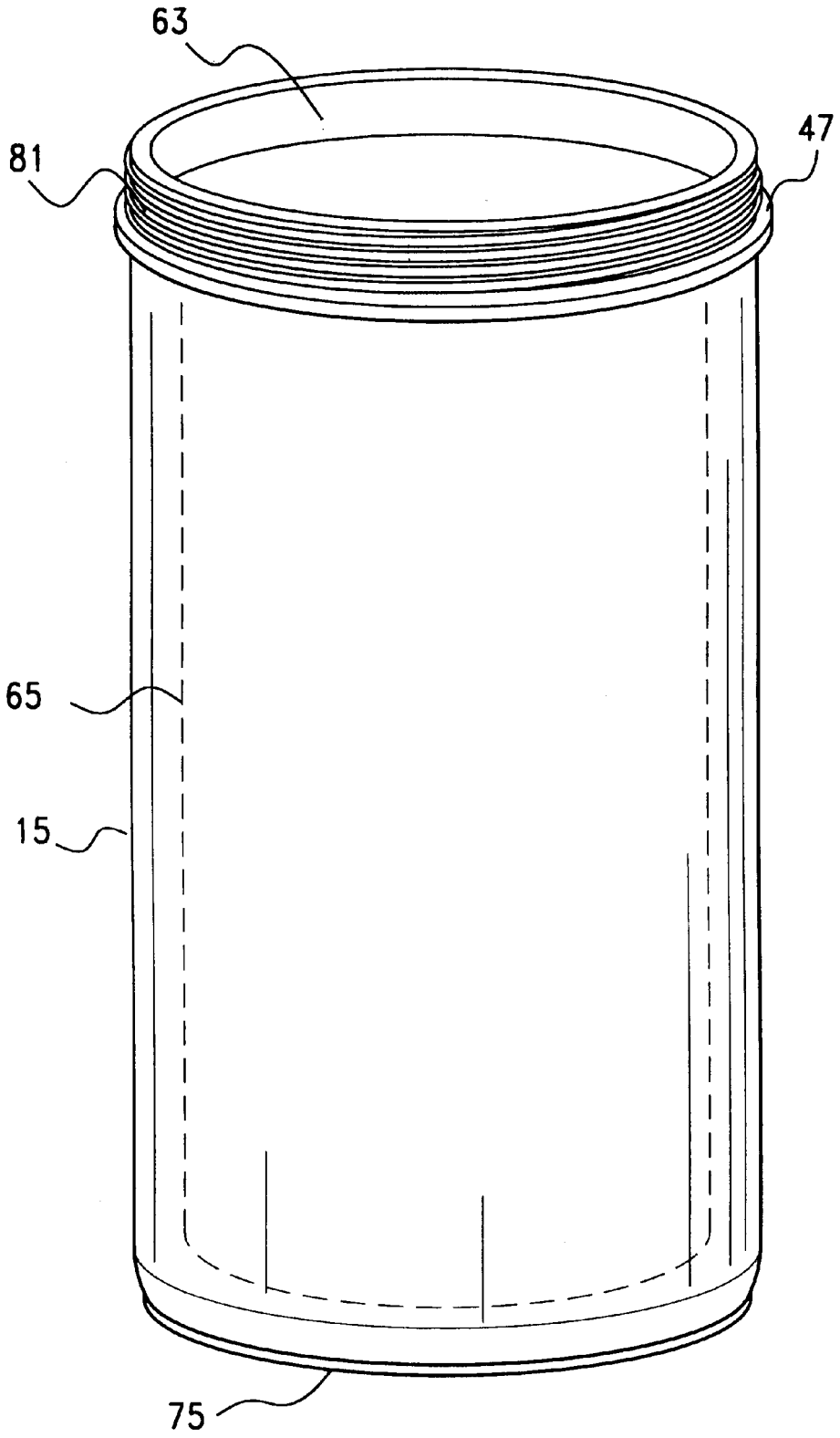
FIG. 3 is first cut away view of a second section of a urinal device according to the present invention.
Figure 4:
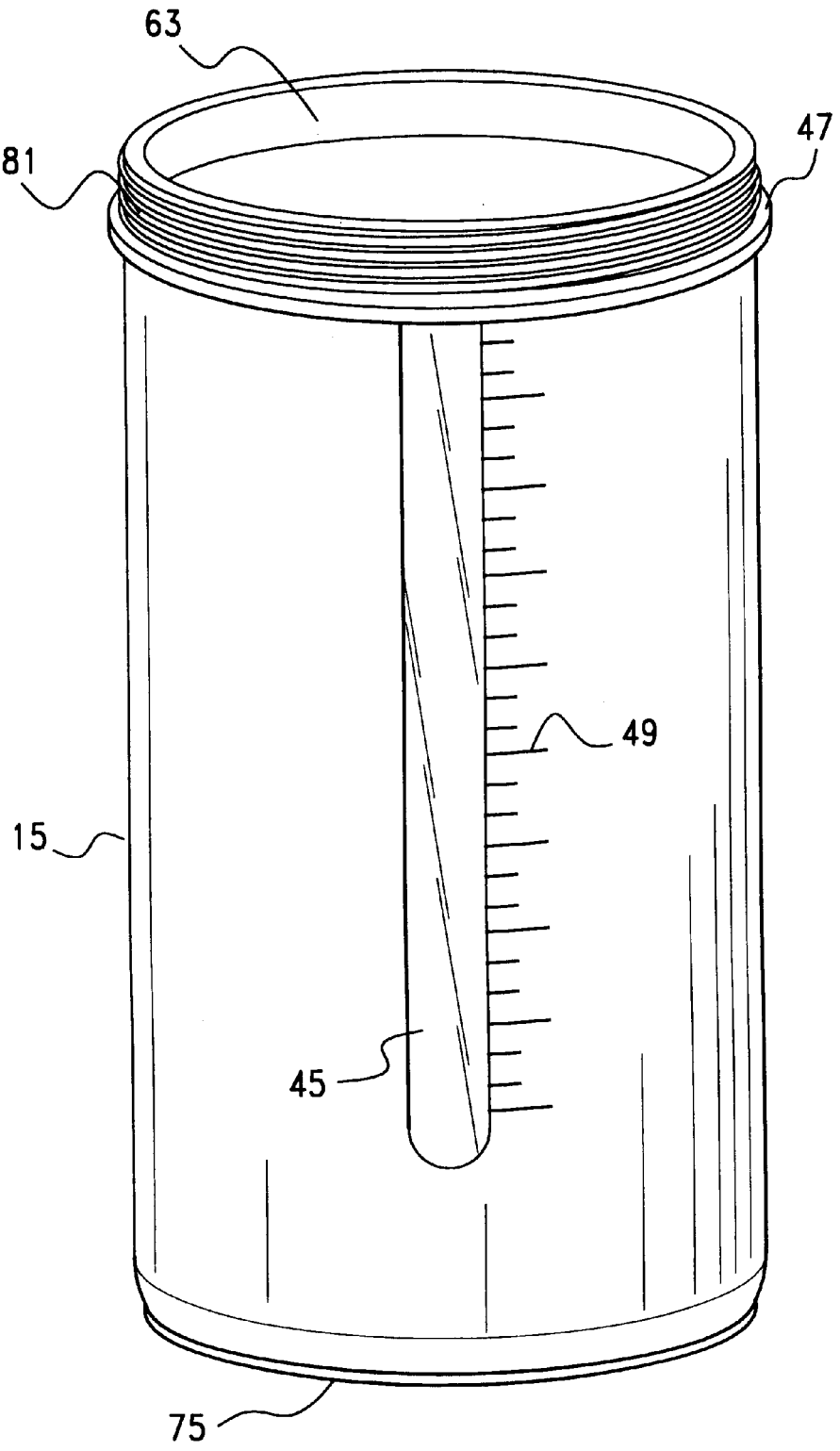
FIG. 4 is a second cut away view of a second section of a urinal device according to the present invention.
Figure 5:
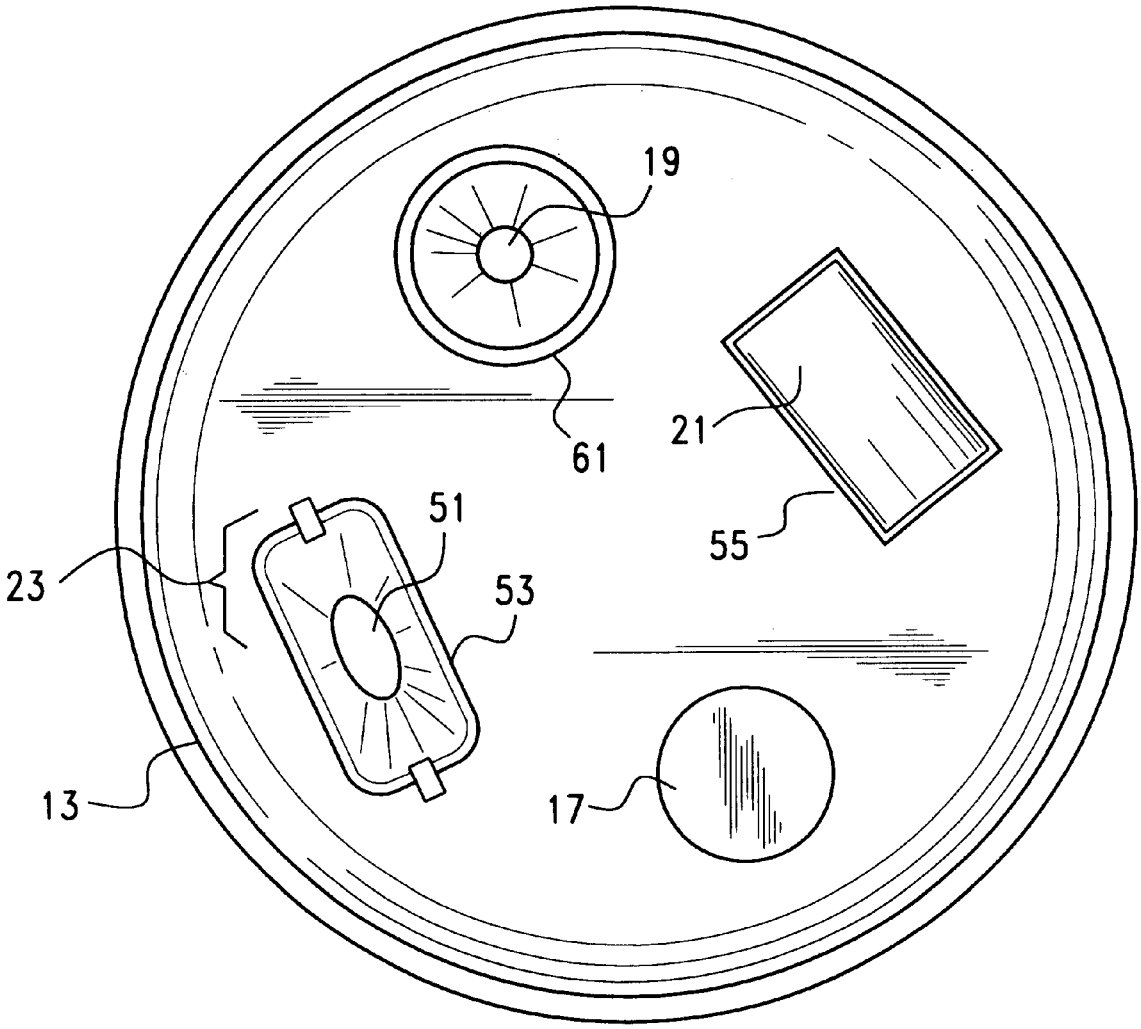
FIG. 5 is a top view of a top surface of an embodiment of the urinal device of the present invention.
Figure 6:
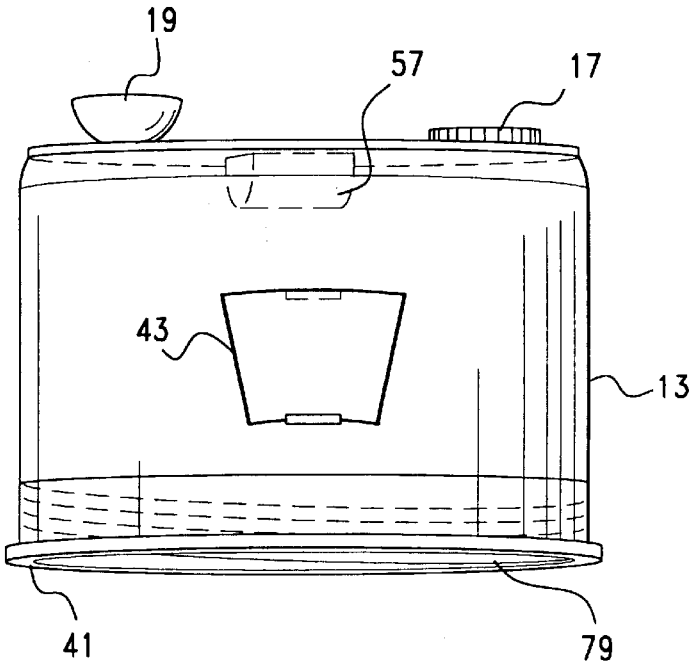
FIG. 6 is a perspective view of a first section of an embodiment of the urinal device of the present invention.

Second section 15 is preferably a hollow cylindrical receptacle having an open end that connects with first section 13. In the illustrated embodiment (FIGS. 3 and 4), first section 13 may include threads 79 and second section 15 may include grooves 81 proximate to the opening to provide a screw connection with first section 13. Of course, first section 13 may be provided with grooves 81 and second section 15 may be provided with threads 79 in accordance with the desires of the designer. Alternatively first section 13 and second section 15 may be snap-fit or connected using any known mechanical connection. To minimize leakage, a gasket (not shown) may be provided at the opening of one or both of first section 13 and second section 15. Preferably, second section 15 is comprised of an opaque, durable plastic material. A window in the form of a transparent plastic strip 45 may be disposed in the second section 15 as illustrated in FIG. 4. The transparent plastic strip may be provided with indicia of the fluid level 49 preferably in the form of numerical markings. To facilitate facile transportability, the second section 15 may also be provided with a strap assembly 70 such as that shown in FIG. 1 including an adjustable strap 67 incorporating a strap tension adjuster 69. At least one end of strap 67 is preferably connected to second section 15 via secondary straps 73 which are, in turn, preferably connected to rods 71 disposed adjacent to bottom half 15. Second section 15 is preferably further provided with base 75.

Figure 8A:
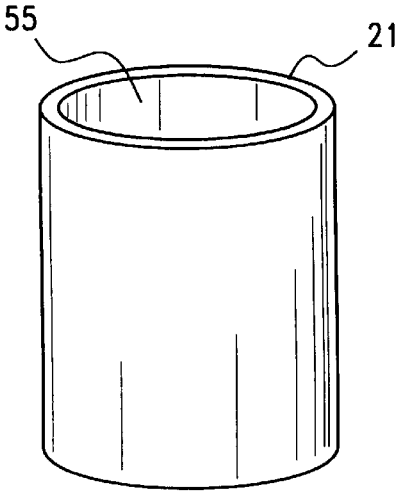
FIG. 8*a* is a perspective view of a male extension member of the present invention.
Figure 8B:
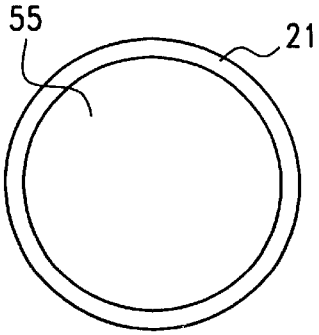
FIG. 8*b* is a top view of a male extension member of the present invention.
Figure 7:
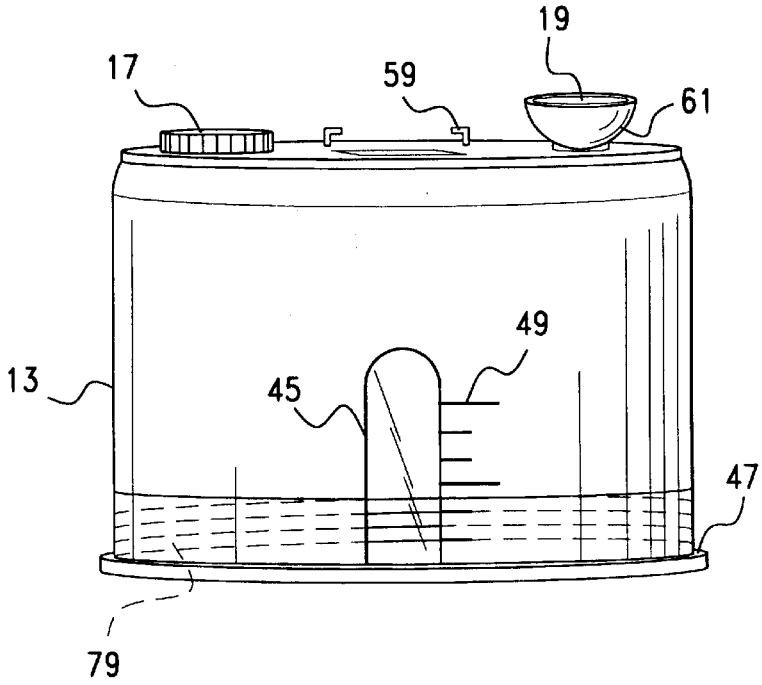
FIG. 7 is a second perspective view of a first section of an embodiment of the urinal device of the present invention.
Figure 9A:
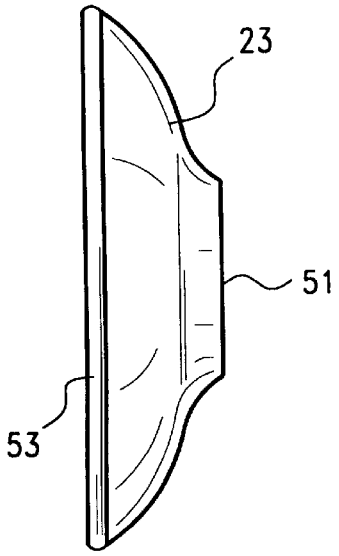
FIG. 9*a* is a side view of a female extension member of the present invention.
Figure 9B:
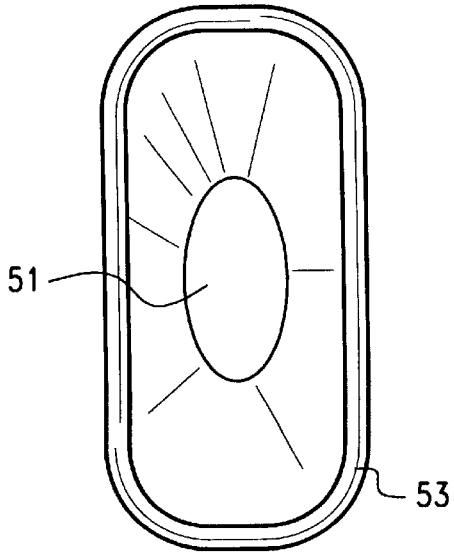
FIG. 9*b* is a top view of a female extension member of the present invention.

In keeping with the invention, as depicted in FIGS. 1, 5–7, the first section 13 is preferably provided with a top surface 22 that may be connected to or integrally formed with top section 13. Top surface 22 preferably includes a funnel shaped tip opening 19 of sufficient width to allow funnel shaped tip 61 to pass therethrough. Further provided on top surface 22 is an indentation 57, best shown in FIG. 6, for storing a male extension member 21. In addition, top surface 22 may be provided with a pair of fingers 59 for storing female extension member 23 thereon. As depicted in FIGS. 8*a* and 8*b*, Male extension member 21 is preferably cylindrical in shape with optimal dimensions of about 2-inches in length and 1-inch in circumference to accommodate the average penis size. As illustrated in FIGS. 9*a* and 9*b*, female extension member 23 is preferably oval shaped with optimal dimensions of about 3-inches in length by 2-inches in width to accommodate the average size vagina. The outside layer of the female extension member may be lined with a thin cushion layer 53 to ensure the comfort in such a delicate area of the body. When the retractable flexible tube 25 is joined with the extension members 21, 23, the user may draw up to about 30-inches out of the urinal device 11.

In accordance with a preferred aspect of the invention, the retractable flexible tube 25 can be slightly tugged or pulled to trigger the retraction of the flexible tube 25 into top section 13. More particularly, flexible tube 25 may be coiled about spindle 31 in the first section 13 by operation of a retractable motor assembly such as that found in a conventional vacuum cleaner. In accordance with a feature of the invention, a preferred retractable motor assembly includes a retractable motor mount 33 and a retractable motor 35 as illustrated in FIG. 2. Retractable motor 35 may operate on either AC or DC power. Batteries stored in battery compartment 43 may provide DC power. In keeping with still another aspect of the invention, flexible tube 25 is preferably durable enough to prevent any bending while coiled around spindle 31 to ensure that the urinal device operates effectively whether or not the suction motor 27 is employed. An easy on/off switch 17 is preferably provided on top surface 22 to activate the vacuum in the suction device.

In operation, a user may draw flexible tube 25 out of urinal device by tugging on funnel shaped tip 19. Either prior to or after extracting flexible tube 25, the user may attach an extension member 21 or 23 to funnel shaped tip 19 and urinate into the extension member. Either prior to or during urination, the user may activate suction device motor 27 to help draw urine through the flexible tube 25 to the second section 15, if desired. The user may then rinse the extensions members 21 and 23 and store them in their respective holders, e.g., indentations 57 and grooves 59. The user may then tug on flexible hose 25 to activate retractable motor 35 thus causing spindle 31 to wind retractable hose 25 back into first section 13. Also, the user may unscrew second section 15 and dispose of the urine collected therein.

What is claimed is:

1. A portable urinal device comprising:

an elongated body having a first section and a second section, the first section being releasably connected to the second section, the first section including a top surface;

a retractable flexible tube having a first end secured within the first section and a second end that is retractable away from the top surface, the flexible tube being disposed about a spindle located within the first section such that the second end is disposed outside the first section;

means for creating suction at the first end of the retractable tube so as to draw fluid from the second end of the flexible tube to the first end of the flexible tube;

a motor operatively engaged with the spindle to rotate the spindle and retract the is flexible tube into the first section; and first and second extension members adapted for coupling to said second end of the flexible tube, said first and second extension members being secured to the top surface of the first section.

2. The portable urinal device of claim 1 wherein the second end of said retractable flexible tube includes a funnel shaped tip.

3. The portable device of claim 1 wherein the second section of said elongated body includes a window having indicia of a level of fluid contained in the second section.

4. The portable device of claim 1 wherein the first extension member includes a cylindrical sheath operative to accomodate an average sized penis.

5. The portable urinal device of claim 4 wherein the first extension member has a length of about two inches and a circumference of about one inch.

6. The portable urinal device of claim 1 wherein the second extension member includes an oval member operative to accommodate an average size vagina.

7. The method of operating the device of claim comprising:

extracting the retractable flexible tube from said elongated body;

attaching one of the first and second extension members to a funnel shaped tip disposed on the second end of said retractable flexible tube; and urinating into the attached extension member.

8. the method of claim 7 further comprising activating said means for creating suction prior to urination.

9. The method of claim 7 further comprising activating said motor to retract the flexible tube into the first section.

* * * * *